US009163626B2

(12) United States Patent
Frank et al.

(10) Patent No.: US 9,163,626 B2
(45) Date of Patent: Oct. 20, 2015

(54) GEAR PUMP

(75) Inventors: Josef Frank, St. Koloman (AT); Alexander Fuchs, Adnet (AT); Klaus Ortner, Salzburg (AT)

(73) Assignee: Robert Bosch GmbH, Stuttgart (DE)

( * ) Notice: Subject to any disclaimer, the term of this patent is extended or adjusted under 35 U.S.C. 154(b) by 501 days.

(21) Appl. No.: 13/387,412

(22) PCT Filed: Jun. 4, 2010

(86) PCT No.: PCT/EP2010/057820

§ 371 (c)(1),
(2), (4) Date: Mar. 23, 2012

(87) PCT Pub. No.: WO2011/012362

PCT Pub. Date: Feb. 3, 2011

(65) Prior Publication Data

US 2012/0171061 A1 Jul. 5, 2012

(30) Foreign Application Priority Data

Jul. 31, 2009 (DE) ..... 10 2009 028 148

(51) Int. Cl.
*F04C 2/08* (2006.01)
*F04C 2/10* (2006.01)
(Continued)

(52) U.S. Cl.
CPC ..... *F04C 2/086* (2013.01); *F04C 2/102* (2013.01); *F04C 11/008* (2013.01); *F04C 15/008* (2013.01); *F04C 2230/22* (2013.01); *F04C 2240/56* (2013.01)

(58) Field of Classification Search
CPC ..... F04B 17/03; F04B 17/046; F04C 2/08; F04C 2/084; F04C 15/008; F04C 18/082; F04C 18/084; F04C 29/0085; F04C 2240/10; F04C 2240/40; F04C 2240/56
USPC ..... 417/355, 356; 384/276
See application file for complete search history.

(56) References Cited

U.S. PATENT DOCUMENTS 2,345,975 A * 4/1944 Herman ..... 418/178
2,761,078 A * 8/1956 McAdam ..... 310/67 R
4,750,847 A * 6/1988 Boyd ..... 384/130
(Continued)

FOREIGN PATENT DOCUMENTS

DE 10248933 12/2003
DE 102006007554 8/2007
(Continued)

OTHER PUBLICATIONS

PCT/EP2010/057820 International Search Report dated Oct. 25, 2011 (3 pages).

*Primary Examiner* — Bryan Lettman
*Assistant Examiner* — Charles W Nichols
(74) *Attorney, Agent, or Firm* — Michael Best & Friedrich LLP

(57) ABSTRACT

The invention relates to a gear pump (1) for conveying a fluid, said gear pump comprising a rotatably mounted, external geared toothed wheel (3) and an internal geared annular gear (2) that are meshed in order to generate a conveying action, and are arranged together with an electrically commutable stator (7) in a housing (5). The stator (7) extends concentrically around the annular gear (2) and interacts with the annular gear to generate an electromotive force. The annular gear (2) has a closed, homogeneous cylindrical surface and a plain bearing (13) is provided on the stator (7).

11 Claims, 2 Drawing Sheets

(51) Int. Cl.
*F04C 11/00* (2006.01)
*F04C 15/00* (2006.01)

(56) References Cited

U.S. PATENT DOCUMENTS

| | | | | | |
|---|---|---|---|---|---|
| 5,145,329 | A | | 9/1992 | Zumbusch et al. | |
| 5,169,242 | A | * | 12/1992 | Blase et al. | 384/99 |
| 6,053,705 | A | * | 4/2000 | Schob et al. | 417/53 |
| 6,074,189 | A | * | 6/2000 | Eckerle | 418/109 |
| 7,137,793 | B2 | | 11/2006 | Shafer et al. | |
| 2005/0042124 | A1 | * | 2/2005 | Miyagi et al. | 418/54 |
| 2005/0265860 | A1 | | 12/2005 | Kameya et al. | |
| 2006/0039815 | A1 | * | 2/2006 | Chertok et al. | 418/61.3 |
| 2008/0159884 | A1 | | 7/2008 | Nakanishi et al. | |
| 2011/0038577 | A1 | * | 2/2011 | Horling et al. | 384/563 |

FOREIGN PATENT DOCUMENTS

| | | |
|---|---|---|
| GB | 2080424 | 2/1982 |
| JP | 2004232578 | 8/2004 |
| JP | 2005098268 | 4/2005 |
| WO | 2005062446 | 7/2005 |

* cited by examiner

GEAR PUMP

BACKGROUND OF THE INVENTION

Rotary screw pumps comprise, amongst other things, internal gear pumps and annular gear pumps in which a driving gearwheel runs eccentrically in the internal tooth system of an annular gear. Internal gear pumps, which are particularly suitable for providing high pressures, are used to deliver fluids, for example to deliver fuel to an internal combustion engine.

In the prior art, it is known to integrate internal gear pumps or annular gear pumps in an electronically commutated electric motor, with the rotor of the electric motor simultaneously being in the form of an annular gear of the internal gear pump or annular gear pump.

DE 10 2006 007 554 A1 describes a delivery pump which is integrated in an electric motor. The delivery pump comprises a first gearwheel and a second gearwheel. A delivery space is formed between the two gearwheels. The second gearwheel is mounted at its centre on a mandrel. The first gearwheel is an external gearwheel and forms the rotor, the second gearwheel is an internal gearwheel which is carried along in the eccentric center of the first gearwheel. The first gearwheel comprises glued-in permanent magnets which are arranged in a manner distributed over the circumference. External magnetic field generators generate a circulating rotationally changing field which results in direct motorized tracking of the rotor.

However, mounting of the annular gear, which has to adopt the drive torque of the electric motor, is problematical in configurations of this kind. At the same time, the hydraulic forces of the internal gear pump are transmitted to the stator and further to the pump housing.

EP 1 600 635 A2 describes an internal gear pump which has a pump section with an internal rotor which is formed with teeth on its outer periphery. An external rotor has teeth which are formed on its inner periphery. Both rotors are accommodated in a housing. The external rotor, which is in the form of an annular gear, is mounted by means of specially shaped additional components in this case.

The solutions known in the prior art for mounting the annular gear in an internal gear pump or in an annular gear pump have a mechanically complicated design and are therefore structurally elaborate, complex and expensive in terms of production.

Therefore, it is necessary to provide a simple and cost-effective solution for mounting an annular gear for a gear pump, in particular for an internal gear pump or an annular gear pump.

SUMMARY OF THE INVENTION

The invention provides a gear pump for delivering a fluid, having a rotatably mounted externally toothed gearwheel and an internally toothed annular gear which engage in a meshing manner for the purpose of generating a delivery effect and which are arranged in a housing together with an electrically commutatable stator, with the stator extending around the annular gear in a concentric manner and interacting with the annular gear for the purpose of generating an electromotive force, and with the annular gear having a closed, homogeneous cylindrical surface and a sliding bearing being provided on the stator. A structurally simple and therefore cost-effective solution for mounting is provided by providing the sliding bearing directly on the stator.

The annular gear is preferably composed of sintered steel or plastic.

According to a preferred embodiment, the motor is in the form of a permanent-magnet synchronous motor and the magnets are integrated in the annular gear.

According to a further preferred embodiment, the motor is in the form of a reluctance motor and holes or special recesses are made in the annular gear in order to form magnetic poles due to field attenuation.

The sliding bearing is preferably formed on the stator as a layer which is applied to a surface of the stator, this surface being opposite the annular gear, and therefore the sliding bearing is integrated in the stator. The stator, which can be a stator of a permanent-magnet motor or a reluctance motor, therefore advantageously acts on the inside diameter simultaneously as a radial bearing for the rotor which is designed as an annular gear or external annular gear of the internal gear pump or annular gear pump. The sliding bearing serves primarily as a wear-prevention layer between the stator and the rotor. In addition, the sliding bearing provides a centering function for the rotor and can reduce or prevent axial gap losses when provided with a corresponding design. This improves the efficiency of the electric motor.

According to a preferred embodiment, the layer is composed of plastic or of a non-ferromagnetic material, in particular of bronze.

According to a further preferred embodiment, the layer has a layer thickness which is less than or equal to 0.3 mm. Since a sliding bearing with a thin layer thickness is integrated in the stator, it is possible to ensure a correspondingly small air gap between the stator and the rotor, in particular when the motor is designed with a reluctance motor. Therefore, good efficiency of the electric motor can be presented.

According to yet another further preferred embodiment, the layer is sprayed, adhesively bonded or vulcanized onto the stator.

Further preference is given to the layer being designed with a projection, and therefore the stator bearing against an inner wall of the housing with a prestress. In particular, the layer is designed such that the prestress has the effect of pressing the sliding bearing in the axial direction and correspondingly upward and against the inner wall when the cover is mounted. This does not create an air gap or creates a very small axial air gap, and accordingly only very minor gap losses occur.

BRIEF DESCRIPTION OF THE DRAWINGS

Exemplary embodiments of the invention will be described in greater detail below with reference to the appended drawings, in which.

DETAILED DESCRIPTION

Figure 1:
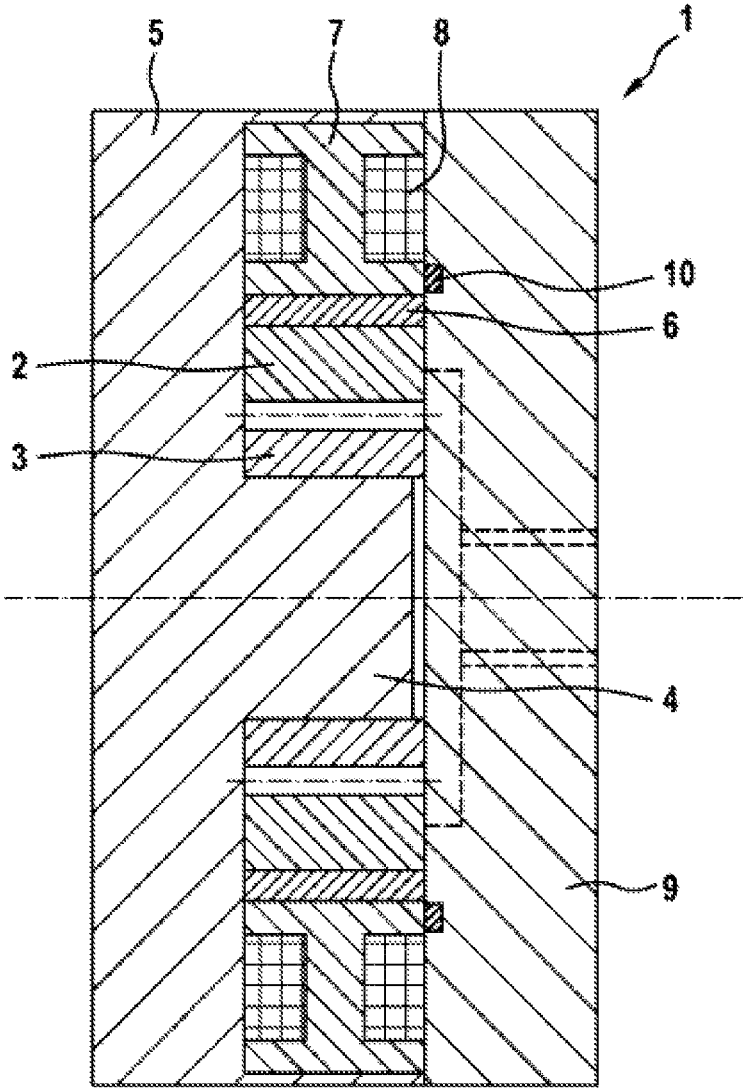
Fig. 1 Prior art
FIG. 1 shows a section through an internal gear pump according to the prior art.

FIG. 1 shows a section though an internal gear pump 1 according to the prior art. The internal gear pump 1 comprises a pair of gearwheels which comprises an internally toothed annular gear 2 and an externally toothed gearwheel 3. The gearwheel 3 is arranged in a rotatable manner on a bearing pin 4 eccentrically with respect to the annular gear 2. If the annular gear 2 is made to rotate, the external tooth system of the gearwheel 3 meshes with the internal tooth system of the annular gear 2 and generates a volumetric delivery flow of the fluid, in which the tooth system runs. The pair of gearwheels comprising the annular gear 2 and the gearwheel 3 is arranged in a housing 5, with the bearing pin 4 being formed in one piece or integrally with the housing 5. Furthermore, the annular gear 2 is connected to an annular magnet 6 in a rotationally fixed manner, with the annular magnet 6 extending around the annular gear 2 in a radially encircling manner. The annular magnet 6 runs in an inner face of a stator 7 which has an electrical winding 8. If the electrical winding 8 is electrically commutated by a control means, a circulating magnetic field is generated in the stator 7. On account of the circulating magnetic field, the annular magnet 6 is made to rotate, with the tooth system comprising the annular gear 2 and the gearwheel 3 being made to operate on account of the rotationally fixed connection between the annular magnet 6 and the annular gear 2. The annular magnet 6 is mounted on the stator 7 in a sliding manner. In this case, the annular magnet 6 is provided with a corresponding coating which is composed of a suitable sliding material. This design is problematical for the use of high delivery pressures and with liquids which exhibit poor lubrication properties, for example gasoline or diesel.

The open side of the housing 5 of the internal gear pump 1 is closed by means of a connection cover 9, with a sealing element 10 being provided in order to seal off the gap between the connection cover 9 and the housing 5 in a fluid-tight manner. The sealing element 10 is designed as an O-ring and is arranged in a corresponding encircling groove (not illustrated) inside the connection cover 9.

Figure 2:
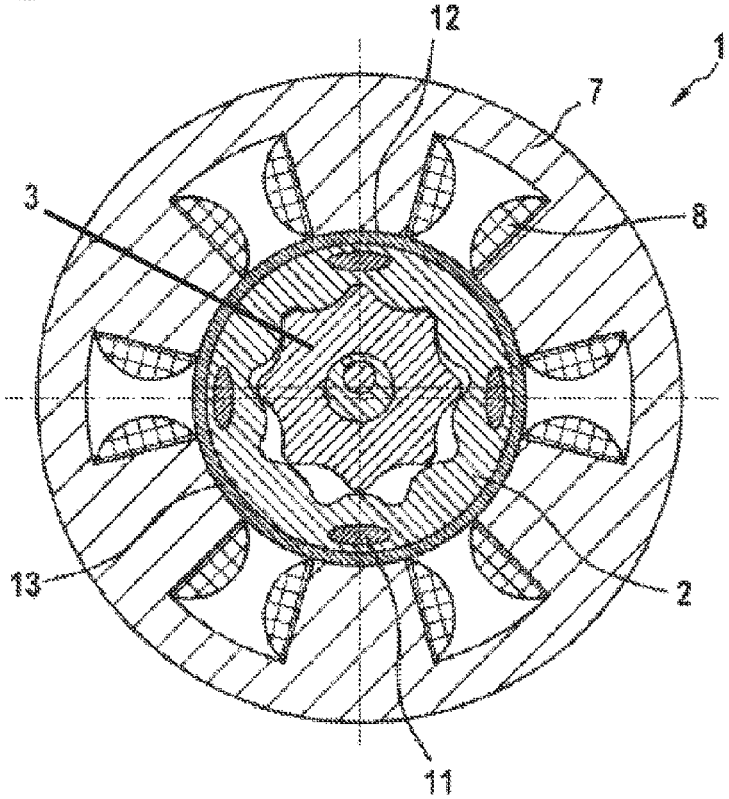
FIG. 2 shows a cross section through an internal gear pump according to one embodiment.

FIG. 2 shows a cross section through an internal gear pump 1 according to one embodiment. A large number of magnets 11 is provided on or in the annular gear 2 which acts as a rotor (permanent-magnet motor). If, as an alternative, the electric motor is in the form of a reluctance motor, holes (not illustrated) for field attenuation are provided instead of the magnets 11.

A sliding bearing 13 is provided on the stator 7 on a cylindrical surface 12 which is opposite the annular gear 2, or the sliding bearing 13 is integrated in the stator 7. The sliding bearing 13 serves primarily as a wear-prevention layer between the stator 7 and the rotor or the annular gear 2. In addition, the sliding bearing 13 has a centering function for the rotor or the annular gear 2 and can reduce or prevent axial gap losses when provided with a corresponding design, as will be explained in greater detail in conjunction with FIG. 3. The sliding bearing 13 is formed by a thin layer of plastic which is sprayed onto the stator 7.

Figure 3:
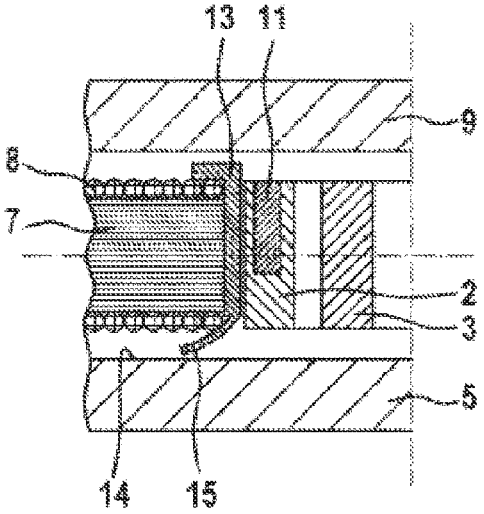
FIG. 3 shows a longitudinal section through the internal gear pump of FIG. 2.

FIG. 3 shows a longitudinal section through the internal gear pump 1 of FIG. 2. Said figure shows that the sliding bearing 13, which is mounted on the stator 7 or is injection-molded into the stator 7, is in the form of a layer with a thickness of less than 0.3 mm which is designed with a projection 15 axially in the direction of an inner wall 14 of the housing 5 in such a way that a prestress is produced by abutment of the layer against the inner wall 14 of the housing 5. When the connection cover 9 is mounted, the sliding bearing 13 is pressed against the inner wall 14 in the axial direction. Therefore, the stator 7 can be axially fixed. Furthermore, this special design of the sliding bearing 13 can be used as an axially encircling sealing-off means.

A structurally simple and therefore cost-effective sliding bearing is provided in the gear pump 1 according to the invention.

The invention claimed is:

1. A gear pump (1) for delivering a fluid, the gear pump (1) having a rotatably mounted externally toothed gearwheel (3) and an internally toothed annular gear (2) which engage in a meshing manner for the purpose of generating a delivery effect and which are arranged in a housing (5) together with an electrically commutatable stator (7), with the stator (7) extending around the annular gear (2) in a concentric manner and interacting with the annular gear for the purpose of generating an electromotive force, characterized in that the annular gear (2) has a closed, homogeneous cylindrical surface and a sliding bearing (13) is provided on the stator (7), the bearing (13) including a projection (15) that extends radially outward from the sliding bearing and that bears axially against an inner wall (14) of the housing (5) with a prestress, and wherein the sliding bearing (13) is formed on the stator (7) as a layer which is applied to a surface (12) of the stator (7), the surface (12) being opposite the annular gear (2), and wherein the sliding bearing (13) includes a portion that extends axially along a radially inner surface of the stator (7).

2. The gear pump (1) as claimed in claim 1, characterized in that the annular gear (2) is composed of sintered steel or plastic.

3. The gear pump (1) as claimed in claim 1, characterized in that the gear pump (1) is in the form of a permanent-magnet synchronous motor and the magnets (11) are integrated in the annular gear (2).

4. The gear pump (1) as claimed in claim 1, characterized in that the gear pump (1) is in the form of a reluctance motor and holes or special recesses are made in the annular gear (2) in order to form magnetic poles due to field attenuation.

5. The gear pump (1) as claimed in claim 1, characterized in that the layer is composed of plastic or of a non-ferromagnetic material.

6. The gear pump (1) as claimed in claim 5, characterized in that the layer is composed of bronze.

7. The gear pump (1) as claimed in claim 1, characterized in that the layer has a layer thickness which is less than or equal to 0.3 mm.

8. The gear pump (1) as claimed in claim 1, characterized in that the layer is sprayed, adhesively bonded or vulcanized onto the stator (7).

9. The gear pump (1) as claimed in claim 1, wherein the projection (15) extends radially outwardly at an angle from the portion of the sliding bearing (13) that extends axially along the radially inner surface of the stator (7).

10. The gear pump (1) as claimed in claim 1, wherein the gear pump (1) further includes a cover (9) disposed axially opposite the inner wall (14) of the housing (5), such that the projection (15) bears axially away from the cover (9) and toward the inner wall (14).

11. The gear pump (1) as claimed in claim 10, wherein the projection (15) does not contact the cover (9).

* * * * *